US005428867A

United States Patent [19]

Hannerstig

[11] Patent Number: 5,428,867

[45] Date of Patent: Jul. 4, 1995

[54] DEVICE FOR DRAPING CURTAINS

[75] Inventor: Christer Hannerstig, Höllviksnäs, Sweden

[73] Assignee: AB A. Svensson & Co., Malmo, Sweden

[21] Appl. No.: 992,037

[22] Filed: Dec. 17, 1992

[30] Foreign Application Priority Data

Dec. 20, 1991 [DE] Germany ..... 9115860 U

[51] Int. Cl.[6] ..... E05D 15/00

[52] U.S. Cl. ..... 16/87.2; 24/113 R; 24/104

[58] Field of Search ..... 16/87.002; 24/90 C, 24/113 R, 104

[56] References Cited

U.S. PATENT DOCUMENTS

| | | | |
|---|---|---|---|
| 327,101 | 9/1885 | Palmer | 24/113 R |
| 644,894 | 3/1900 | Carlin | 24/104 |
| 759,045 | 5/1904 | Tracy | 16/87.2 |
| 982,610 | 1/1911 | Knight | 16/87.2 |
| 2,320,308 | 5/1943 | Silverman | 16/87.2 |
| 2,443,372 | 6/1948 | Bertram | 24/104 |
| 3,142,878 | 8/1964 | Santora | 24/113 R |
| 3,322,182 | 5/1967 | Palella | 16/87.2 |
| 5,282,292 | 2/1994 | Levy | 16/87.2 |

*Primary Examiner*—P. Austin Bradley
*Assistant Examiner*—Chuck Y. Mah

[57] ABSTRACT

A device for draping curtain fabrics includes a retainer for positioning the curtain fabric in a predetermined arrangement. A disk-like cover is secured to the retainer. The disk-like cover includes a mounting side and securing means removably secured thereto for selectively securing the disk-like cover to the retainer.

16 Claims, 4 Drawing Sheets

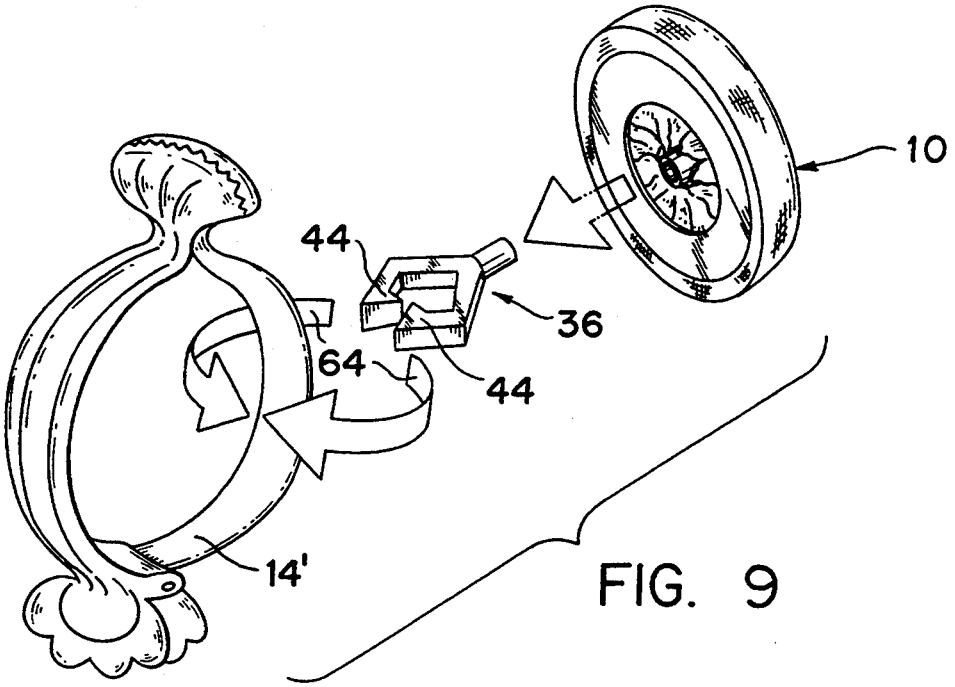
FIG. 9
FIG. 10
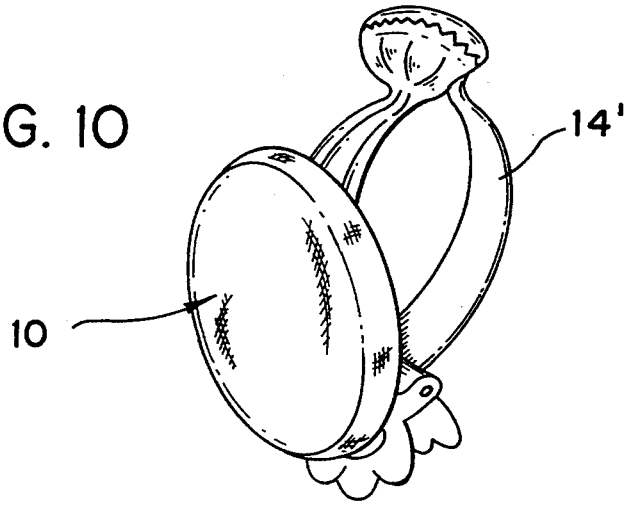

DEVICE FOR DRAPING CURTAINS

BACKGROUND OF THE INVENTION

1.Field of Invention

This invention relates to a device for draping curtains, the device comprising a disk-like cover which is adapted to be secured to a retainer or other furnishing element provided for fixing the curtain fabric with predetermined folds or draping.

2. Description of Background Art

In a previously known device of the specified kind the disk-like cover is secured to the retainer or other furnishing element, which is provided for fixing the curtain fabric with predetermined folds or draping, by means of a pin-and-socket connection. The pin-and-socket connection comprises a pin which is preferentially disposed on the mounting or rear side of the disk-like cover and a mating hole, receptacle or the like for receiving the pin and preferentially provided on the retainer or other furnishing element. Because of such a pin-and-socket connection the known device for draping curtains, which has been widely accepted for practical use, exhibits a certain drawback. Firstly, the manufacture of the known device is relatively expensive because the disk-like cover must be provided with the pin and additionally, i.e. in a separate operation, the hole, receptacle or the like corresponding to the pin must be formed in the retainer or other furnishing element. Secondly, assembly of the known device is rather cumbersome because the pin on the disk-like cover has to be properly aimed at the precisely mating hole, receptacle or the like while in most cases the curtain fabric has to be retained with its predetermined folds or draping. Also, in some cases the use of the known device may be restricted when, for instance, the rear or mounting side instead of the front of the disk-like cover is presented to the viewer on account of irregular fastening of the retainer or slipping of the furnishing element, so that the optically enhancing effect which basically results from the disk-like cover when draping curtains will be detrimentally affected.

SUMMARY AND OBJECTS OF THE INVENTION

The present invention has as its objective the further improvement of the device of the above-specified kind so as to simplify manufacture and assembly thereof and to make it more versatile in use while maintaining a consistent, optically enhancing impression to the viewer.

On account of the securing means such as a latch, snap, hook or similar means which is provided on the mounting or rear side of the disk-like cover and is intended to be secured to a retainer or other furnishing element, manufacture and assembly of the device according to the invention as a whole have been considerably simplified. Since it is possible to fix the disk-like cover to the retainer or other furnishing element solely by the latch, snap, hook or similar means disposed on the mounting or rear side, no special structural features are required on the retainer or other furnishing element for a mutual and safe interengagement with said latch, snap, hook or similar means on the disk-like cover. In this connection any additional processing, i.e. a separate operation, for such structural features is unnecessary. Moreover, the disk-like cover due to the latch, snap, hook or similar means may be secured almost anywhere on the retainer or furnishing element so that any precise positioning of disk-like cover and retainer or furnishing element with respect to each other prior to mutual interengagement is not required. Finally, the latch, snap, hook or similar means also ensures the versatile use of the device according to the invention because in case of irregular mounting of the retainer or slipping of the furnishing element on an already draped curtain fabric, which may for example be folded to a beam-like bundle, the disk-like cover may be displaced from its initial position and fixed again at another location of the retainer or furnishing element.

Moreover, the measures according to the invention are particularly advantageous: it is ensured thereby that the disk-like cover may be fixed to the retainer or furnishing element without requiring any further structure on the retainer or furnishing element for cooperation with the latch, snap, hook or similar means of the disk-like cover. Accordingly, simple and rapid mounting of the disk-like cover on the retainer or furnishing element is effected by a substantially U-shaped, C-shaped or similarly configured member provided on the retainer or furnishing element as said latch, snap, hook or similar means, the two free ends of said member at least partially encompassing the retainer or furnishing element.

The measures according to the invention make it possible additionally to increase the detachable connection between disk-like cover on the one hand and retainer or furnishing element on the other hand due to frictional engagement.

Moreover, the bevels on both free ends of the U-shaped, C-shaped or similarly configured part of the latch, snap, hook or like means essentially facilitate locking or embracing of retainer or furnishing element.

Features are provided for dimensionally stable accommodation of the retainer or furnishing element in the substantially U-shaped, C-shaped or similarly configured part of the latch, snap, hook or similar means. Thus, the mutually abutting relationship between the substantially U-shaped, C-shaped or similarly configured part and the outer surface of the encompassed retainer or furnishing element virtually excludes any rotary movement of the latch, snap, hook or similar means.

Finally, due to the inventive releasable design of the latch, snap, hook or similar means with respect to the disk-like cover there exist various possible combinations prior to mounting the disk-like cover on the retainer or furnishing element when the curtain fabric is being draped, because the latch, hook or similar means may be mounted on differently designed disk-like covers, on the one hand, and on the other hand it may be adapted to the respective size and shape of the retainer or furnishing element.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein:

FIG. 9 and 10 are perspective views showing the step of mounting a cover on a conventional draping clasp by means of the connecting element of the present invention.

DETAILED DESCRIPTION OF THE PREFERRED EMBODIMENTS

Figure 1:
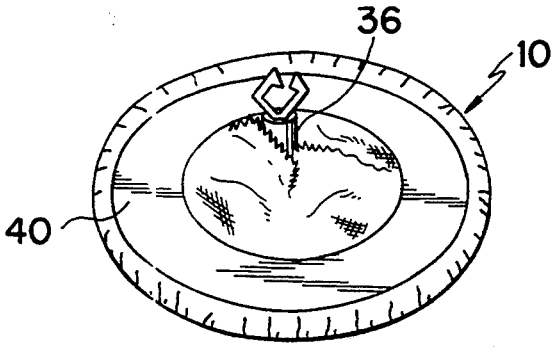
FIG. 1 is a perspective rear view showing an embodiment of a disk-like cover in accordance with the invention.
Figure 2:
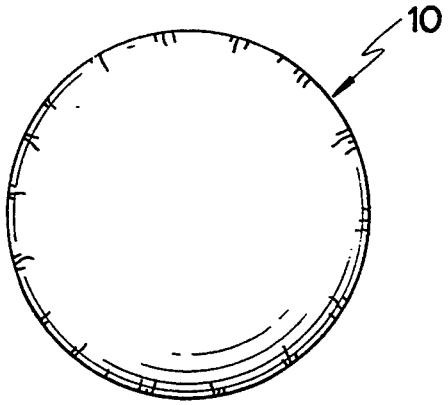
FIG. 2 is a front view of the cover according to the invention as illustrated in FIG. 1.

The device for draping curtains comprises a disk-like cover as shown in FIGS. 1 and 2 which can be secured to a retainer 12 or other furnishing element 14.

Figure 3:
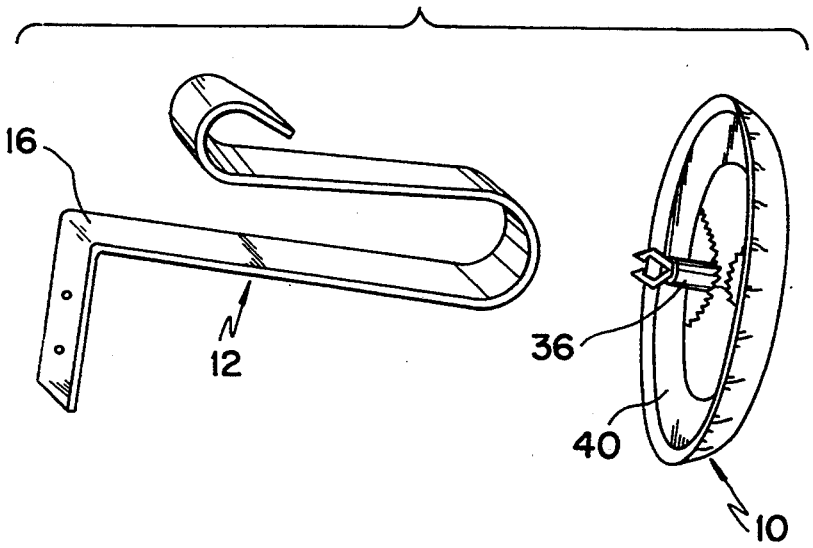
FIG. 3 is a perspective view of the cover of the invention as illustrated in FIG. 1 in combination with a retainer.
Figure 4:
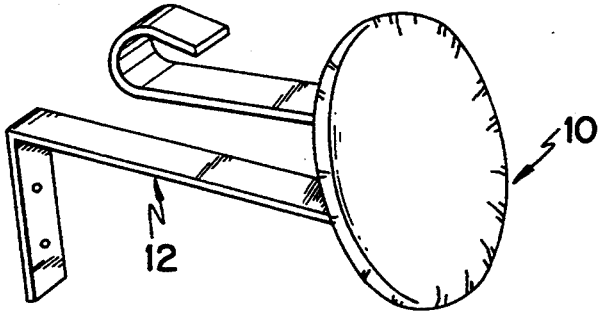
FIG. 4 is a perspective view showing the cover of the invention as illustrated in FIG. 3 and mounted on the front side of a retainer.

The retainer 12 illustrated in FIGS. 3 and 4 is provided, for instance, above a window or door (not illustrated) and adapted to be mounted on a wall in spaced relationship therefrom by means of an L-shaped bracket 16. In this way the respective curtain fabric can be turned about the retainer 12 with predetermined folds or draping and can be fixed thereon. As an additional design feature with respect to the special folding of the curtain fabric, the free front end of the retainer 12 may be provided with the disk-like cover 10 whereby the retainer 12 may be essentially masked. The retainer 12 illustrated in FIGS. 3 and 4 is described, for instance, in EP-B 265,759.

Figure 5:
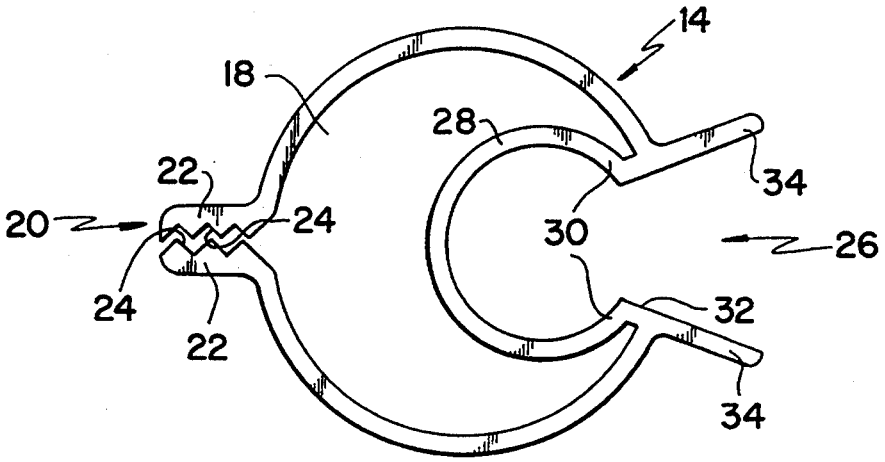
FIG. 5 is a side view of another furnishing element.

The furnishing element 14 of FIG. 5 is provided as an alternative or supplement for fixing the curtain fabric with predetermined folds or draping. The furnishing element 14 is of substantially annular or similar shape so as to be able to encompass the curtain fabric which will then be within the space 18 of the furnishing element 14. The furnishing element 14 comprises an accommodation opening 20 which is spring-loaded and may be spread apart against the spring action for accommodation or withdrawal of the curtain fabric. The accommodation opening 20 is formed by two projections 22 which extend radially outwardly away from the furnishing element 14 and each include a profile, serrations 24 or the like for mutual interengagement when the accommodation opening 20 is not spread apart. Due to the serrations 24 the inserted curtain fabric will be unable to automatically detach itself from the furnishing element 14. A spring 26 or the like, which is integral with the furnishing element 14, is disposed diametrically opposite to the accommodation opening 20 of the furnishing element 14. The spring 26 is a U-shaped, C-shaped or similarly configured part 28 the two free ends 30 of which are fixedly joined to the furnishing element 14. A spring aperture 32 is provided between the two free ends of the part 28 of the spring 26. To facilitate spreading apart of the accommodation opening 20 against the action of the spring 26, two projections 34 are additionally provided in this area which extend away from the furnishing element 14.

Figure 6:
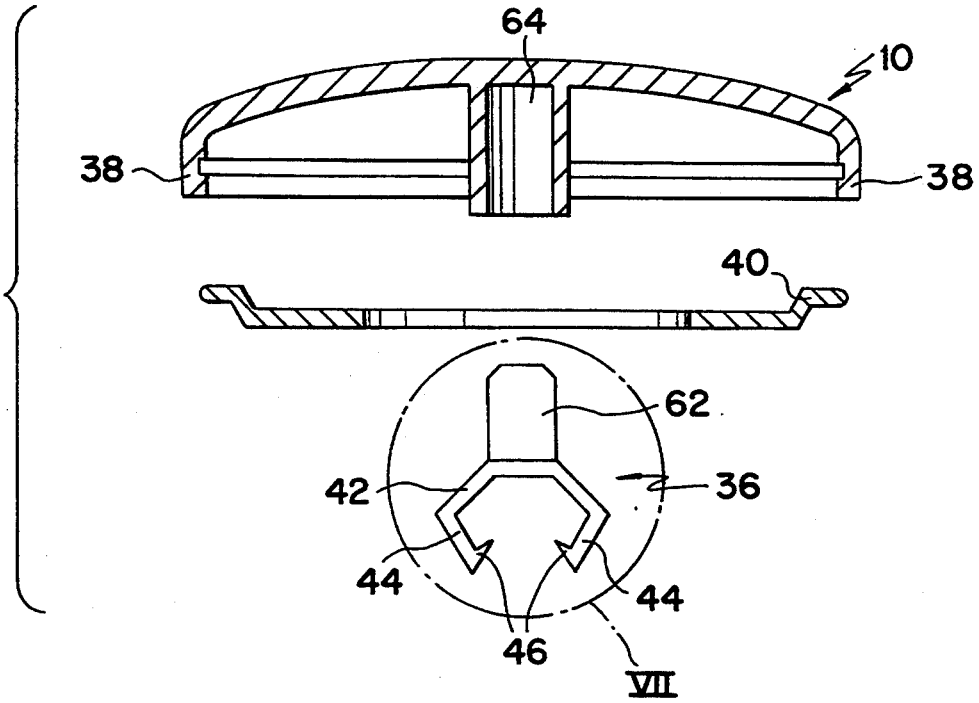
FIG. 6 is an enlarged central cross-sectional view of an embodiment of the cover according to the invention as shown in FIG. 1.

The disk-like cover according to FIGS. 1, 2 and 6 is provided with latch, snap, hook or similar means 36 whereby the disk-like cover 10 may be fixed anywhere on the retainer 12, the furnishing element 14 or the like. The latch, snap, hook or similar means 36 is provided on the mounting or rear side of the disk-like cover 10, i.e. on the side respectively facing the retainer 12 or the furnishing element 14. Furthermore, the mounting side of the disk-like cover 10 comprises a circumferential skirt 38 into which a retaining ring 40 may be fitted to thereby retain drapery or the like which is turned over the front of the cover and the circumferential skirt 38 thereof.

Figure 7A:
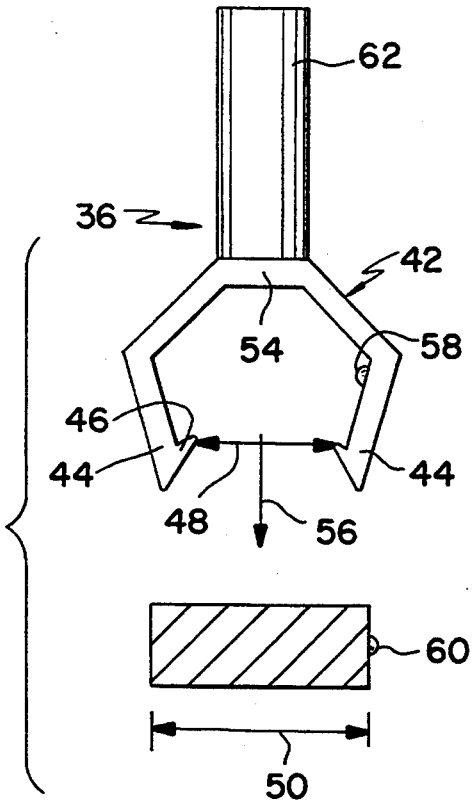
FIG. 7*a* and 7*b* are respective cross-sectional side views of the cover according to the invention corresponding to the detail VII in FIG. 6 in enlarged representation, in combination with a retainer of FIG. 3 and a furnishing element of FIG. 5, respectively, in a pre-assembled state.
Figure 7B:
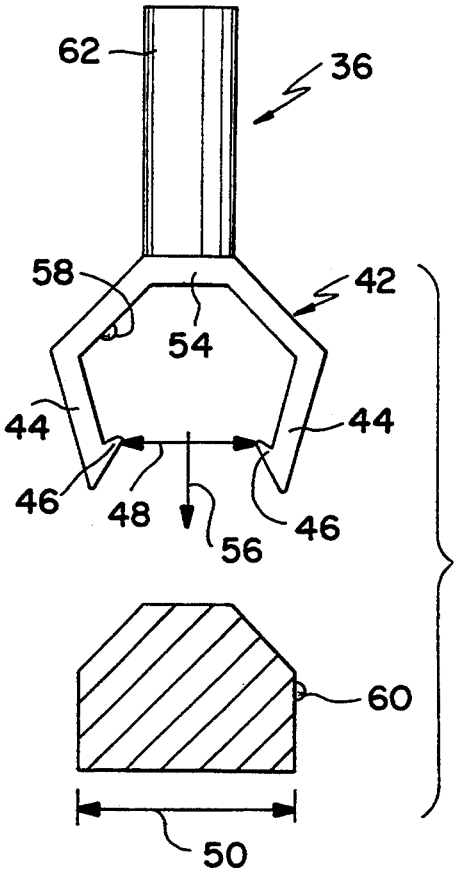
Figure 8A:
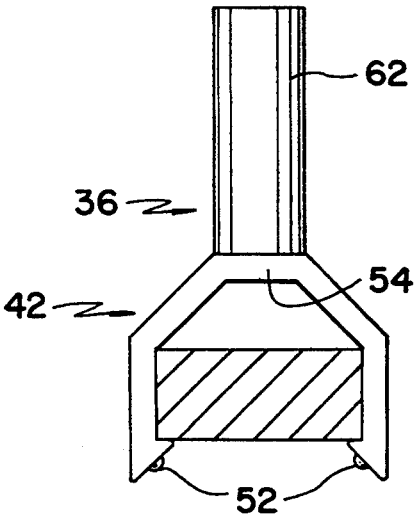
FIG. 8*a* and 8*b* are respective cross-sectional side views of the cover of the invention as shown in FIG. 7 together with a retainer of FIG. 3 and a furnishing element of FIG. 5, respectively, in a pre-assembled state.
Figure 8B:
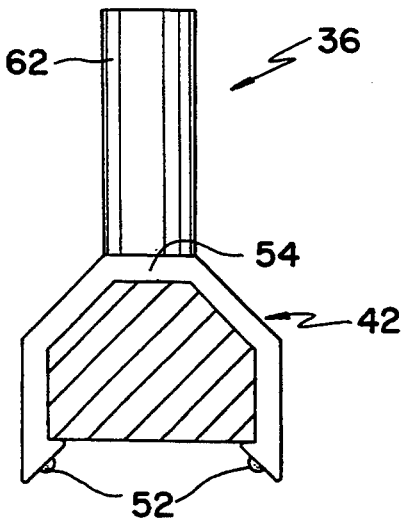

In accordance with FIGS. 6 to 8 the latch, snap, hook or similar means 36 of the disk-like cover 10 comprises a substantially U-shaped, C-shaped or similarly configured part 42 the two free ends 44 of which at least partly encompass the retainer 12 or the furnishing element 14— which are respectively illustrated in cross-section in FIGS. 7 and 8— for securing the disk-like cover 10 to the retainer 12 or furnishing element 14. In order to prevent the latch, snap, hook or similar means 36 and hence the entire disk-like cover 10 from becoming detached from the retainer 12 or furnishing element 14, additional structural measures are provided for a positive and/or frictional engagement between said retaining means such as a latch, snap, hook or similar means 36 and the retainer 12 or furnishing element 14. Firstly, the two free ends 44 of the substantially U-shaped, C-shaped or similarly configured part 42 are each provided with a hook-like protrusion 46. The protrusions 46 are disposed in approximate opposed relationship and extend mutually towards one another. Secondly, the clear width 48 between the two ends 44 of the substantially U-shaped, C-shaped or similarly configured part 42 or the protrusions 46 provided thereon is selected to be less than the maximum width 50 of the retainer 12 or furnishing element 14. Furthermore, the two free ends 44 of the substantially U-shaped, C-shaped or similarly configured part 42 are spring loaded in the direction of the respective other one of the two free ends 44.

Moreover, the two free ends 44 of the substantially U-shaped, C-shaped or similarly configured part 42 of the latch, snap, hook or similar means 36 are provided with bevels 52 extending approximately from the outside towards the inside in the direction of a web 54 joining the two free ends 44 of the U-shaped, C-shaped or similarly configured part 42. This facilitates latching or encompassing of retainer 12 or furnishing element 14 upon a movement of the latch, snap, hook or similar means 36 in the direction of the arrow 56. The bevels 52 act, as it were, as threading means for the retainer 12 or furnishing element 14 while the U-shaped, C-shaped or similarly configured part 42 is spread apart upon a movement of the latch, snap, hook or similar means 36 in the direction of the arrow 56.

In addition to that, the U-shaped, C-shaped or similarly configured part 42 of the latch, snap, hook or similar means 36 is configured in accordance with FIGS. *7a*, *7b*, *8a* and *8b* such that its inner surface 58 and the outer surface 60 of the encompassed retainer 12 or furnishing element 14 are at least partly brought into an abutting relationship. This offers the advantage that the latch, snap, hook or similar means 36 and hence the disk-like cover 10 cannot be rotated about the retainer 12 or the furnishing element 14 after having been mounted thereon. In this respect the mounting of the disk-like cover 10 on the retainer 12 or furnishing element 14 has been additionally improved.

On its mounting or rear side the latch, snap, hook or similar means 36 is preferentially releasably connected to the disk-like cover 10. To this end the latch, snap, hook or similar means 36 includes an integrally formed insertable pin or threaded bolt 62— as illustrated in FIGS. *7a*, *7b*, *8a* and *8b*— for insertion in a receptacle 64 of FIG. 6 provided on the mounting or rear side of the disk-like cover 10. As an alternative, the latch, snap, hook or similar means 36 may also be secured to the disk-like cover 10 in the receptacle 64 by means of a screw or the like, in which case the screw passes through a hole (not illustrated) which is formed in the web 54 of the substantially U-shaped, C-shaped or similarly configured part 42. The releasable connection of the latch, snap, hook or similar means 36, on the one hand, and the disk-like cover 10, on the other hand, provides for the versatile utilisation of the device according to the present invention for the draping of curtains and for highly variable possible designs of the device of the present invention. Thus the latch, snap, hook or similar means is readily exchangeable for differently shaped retainers 12 or furnishing elements 14. Moreover, even after having been fastened to the retainer 12 or the furnishing element 14, the disk-like cover 10 may be rotated as desired in accordance with the pattern of the drapery so that it may adopt desired positions.

FIGS. 9 and 10 illustrate mounting of the disk-like cover 10 on a conventional draping clasp 14' by means of the aforedescribed latch, snap and hook element 36. The draping clasp is preferably made of thin sheet metal, particularly of brass sheet. The arrows 64 indicate the latching or snapping movement of the resilient tines of the aforementioned connecting element 36 after the free ends 44 thereof have been pushed over the two narrow sides of the one clasp half.

All of the features disclosed in the present application documents are claimed as being essential for the invention to the extent to which they are novel over the prior art either individually or in combination.

I claim:

1. A device for draping curtain fabric, said device comprising:

a retainer for positioning the curtain fabric in a predetermined arrangement; and a disk-like cover for securing to said retainer;

said disk-like cover includes a mounting side and securing means removably thereto for selectively securing said disk-like cover to said retainer;

said securing means of the disk-like cover includes a substantially U-shaped configured member having free ends for at least partly encompassing the retainer for securing the disk-like cover to the retainer, both free ends of said substantially U-shaped configured member of the securing means each being provided with a hook-like projection, said projections being approximately opposite each other and extending towards one another.

2. A device for draping curtain fabric, said device comprising:

a retainer for positioning the curtain fabric in a predetermined arrangement; and a disk-like cover for securing to said retainer;

said disk-like cover includes a mounting side and securing means removably secured thereto for selectively securing said disk-like cover to said retainer;

said securing means of the disk-like cover includes a substantially U-shaped configured member having free ends for at least partly encompassing the retainer for securing the disk-like cover to the retainer, wherein the clear width between the two ends of the substantially U-shaped configured member of the securing means provided thereon is smaller than the width of the retainer.

3. A device for draping curtain fabric, said device comprising:

a retainer for positioning the curtain fabric in a predetermined arrangement; and a disk-like cover for securing to said retainer;

said disk-like cover includes a mounting side and securing means removably secured thereto for selectively securing said disk-like cover to said retainer;

said securing means of the disk-like cover includes a substantially U-shaped configured member having free ends for at least partly encompassing the retainer for securing the disk-like cover to the retainer, wherein the two free ends of the substantially U-shaped configured member of the securing means are mutually spring-loaded towards one another.

4. The device according to claim 3, wherein the two free ends of the substantially U-shaped configured member of the securing means are provided with bevels which facilitate engagement with the retainer, said bevels extending from outside approximately inwardly in the direction toward a web interconnecting the two free ends of the U-shaped configured member.

5. The device according to claim 4, wherein the substantially U-shaped configured member of the securing means is designed such that the inner surface thereof and the outer surface of the encompassed retainer are at least partly in mutual abutment.

6. A device for draping curtain fabric, said device comprising:

a retainer for positioning the curtain fabric in a predetermined arrangement; and a disk-like cover for securing to said retainer;

said disk-like cover includes a mounting side and securing means removably secured thereto for selectively securing said disk-like cover to said retainer;

said securing means of the disk-like cover includes a substantially C-shaped configured member having free ends for at least partly encompassing the retainer for securing the disk-like cover to the retainer, wherein both free ends of the substantially C-shaped configured member of the securing means are each provided with a hook-like projection, said projections being approximately opposite each other and extending towards one another.

7. A device for draping curtain fabric, said device comprising:

a retainer for positioning the curtain fabric in a predetermined arrangement; and a disk-like cover for securing to said retainer;

said disk-like cover includes a mounting side and securing means removably secured thereto for selectively securing said disk-like cover to said retainer;

said securing means of the disk-like cover includes a substantially C-shaped configured member having free ends for at least partly encompassing the retainer for securing the disk-like cover to the retainer, wherein a clear width between the two ends of the substantially C-shaped configured member of the securing means provided thereon is smaller than the width of the retainer.

8. A device for draping curtain fabric, said device comprising:

a retainer for positioning the curtain fabric in a predetermined arrangement; and a disk-like cover for securing to said retainer;

said disk-like cover includes a mounting side and securing means removably secured thereto for selectively securing said disk-like cover to said retainer;

said securing means of the disk-like cover includes a substantially C-shaped configured member having free ends for at least partly encompassing the retainer for securing the disk-like cover to the retainer, wherein the two free ends of the substantially C-shaped configured member of the securing means are mutually spring-loaded towards one another.

9. The device according to claim 8, wherein the two free ends of the substantially C-shaped configured member of the securing means are provided with bevels which facilitate engagement with the retainer, said bevels extending from outside approximately inwardly in the direction toward a web interconnecting the two free ends of the C-shaped configured member.

10. The device according to claim 9, wherein the substantially C-shaped configured member of the securing means is designed such that the inner surface thereof and the outer surface of the encompassed retainer are at least partly in mutual abutment.

11. A device for draping curtain fabric, said device comprising:

a retainer for positioning the curtain fabric in a predetermined arrangement; and a cover for securing to said retainer;

said cover includes a mounting side and securing means removably secured thereto for selectively securing said cover to said retainer;

said securing means of the cover includes a substantially U-shaped configured member having free ends for at least partly encompassing the retainer for securing the cover to the retainer both free ends of said substantially U-shaped configured member of the securing means each being provided with a hook-like projection, said projections being approximately opposite each other and extending towards one another.

12. A device for draping curtain fabric, said device comprising:

a retainer for positioning the curtain fabric in a predetermined arrangement; and a cover for securing to said retainer;

said cover includes a mounting side and securing means removably secured thereto for selectively securing said cover to said retainer;

said securing means of the cover includes a substantially U-shaped configured member having free ends for at least partly encompassing the retainer for securing the cover to the retainer, wherein the clear width between the two ends of the substantially U-shaped configured member of the securing means provided thereon is smaller than the width of the retainer.

13. A device for draping curtain fabric, said device comprising:

a retainer for positioning the curtain fabric in a predetermined arrangement; and a cover for securing to said retainer;

said cover includes a mounting side and securing means removably secured thereto for selectively securing said cover to said retainer;

said securing means of the cover includes a substantially U-shaped configured member having free ends for at least partly encompassing the retainer for securing the cover to the retainer, wherein the two free ends of the substantially U-shaped configured member of the securing means are mutually spring-loaded towards one another.

14. A device for draping curtain fabric, said device comprising:

a retainer for positioning the curtain fabric in a predetermined arrangement; and a cover for securing to said retainer;

said cover includes a mounting side and securing means removably secured thereto for selectively securing said cover to said retainer;

said securing means of the cover includes a substantially C-shaped configured member having free ends for at least partly encompassing the retainer for securing the cover to the retainer, wherein both free ends of the substantially C-shaped configured member of the securing means are each provided with a hook-like projection, said projections being approximately opposite each other and extending towards one another.

15. A device for draping curtain fabric, said device comprising:

a retainer for positioning the curtain fabric in a predetermined arrangement; and a cover for securing to said retainer;

said cover includes a mounting side and securing means removably secured thereto for selectively securing said cover to said retainer;

said securing means of the cover includes a substantially C-shaped configured member having free ends for at least partly encompassing the retainer for securing the cover to the retainer, wherein a clear width between the two ends of the substantially C-shaped configured member of the securing means provided thereon is smaller than the width of the retainer.

16. A device for draping curtain fabric, said device comprising:

a retainer for positioning the curtain fabric in a predetermined arrangement; and a cover for securing to said retainer;

said cover includes a mounting side and securing means removably secured thereto for selectively securing said cover to said retainer;

said securing means of the cover includes a substantially C-shaped configured member having free ends for at least partly encompassing the retainer for securing the cover to the retainer, wherein the two free ends of the substantially C-shaped configured member of the securing means are mutually spring-loaded towards one another.

* * * * *